US006397482B1

(12) United States Patent
Chipman

(10) Patent No.: US 6,397,482 B1
(45) Date of Patent: Jun. 4, 2002

(54) SCOPE SIGHT FOR ARCHERS

(76) Inventor: Donald I. Chipman, 10510 265th St., Clear Lake, IA (US) 50428

( * ) Notice: Subject to any disclaimer, the term of this patent is extended or adjusted under 35 U.S.C. 154(b) by 0 days.

(21) Appl. No.: 09/492,396

(22) Filed: Jan. 27, 2000

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 3,871,105 A * 3/1975 Brougham ..... 33/265
4,020,560 A * 5/1977 Heck ..... 33/265
4,669,196 A * 6/1987 Kersey ..... 33/265
5,414,936 A * 5/1995 Sappington ..... 33/265
5,722,175 A * 3/1998 Slates ..... 33/265

* cited by examiner

*Primary Examiner*—Christopher W. Fulton
(74) *Attorney, Agent, or Firm*—Gerald E. Helget; Briggs and Morgan

(57) ABSTRACT

An improved sight holder for an archery bow including an accurate and rapidly adjustable vertical adjustment, an improved adjustment with axial direction to the arrow. The holder is easily used. The vertical adjustment uses a novel double-threaded screw device so as to achieve both a rapid adjustment by a coarse screw and a delicate adjustment by a fine screw with both threads cut into the same screw shaft and separately engageable nut devices. The adjustment on the line of flight is improved by use of a bar which is tapered to allow a forced tight fit to be accomplished by use of a finger-operated set screw.

16 Claims, 5 Drawing Sheets

SCOPE SIGHT FOR ARCHERS

BACKGROUND AND SUMMARY OF THE INVENTION

This invention pertains to bow sights particularly useful for archers who desire the best accuracy in placement of the arrow being shot. This may include both contestants in archery contests and hunters for whom accurate shooting is important. Many of the sights include scopes and all such sights, whether with or without scopes, should be adjustable for distance where such may be variable. Adjustments should be provided for dimensions vertically, and laterally of the bow as well as for line-of-sight directions. It is therefore important that the adjustments should be both easy and quick.

Vertical adjustment of the sight may be more used than lateral adjustment, and is apt to be required frequently and in the field. It may also be useful to replicate the setting with some frequency so that the ability to make and mark an accurate setting becomes desirable. It may also be desirable to be able to remove the sight from the bow easily and quickly.

In the line-of-flight adjustment, it is important that the setting remain constant relative to the vertical setting. Therefore it is important that the bar holding the sight laterally away from the bow not be loose or uncertainly placed.

By this invention, the adjustments are greatly improved in the respects noted.

DESCRIPTION

Figure 1:
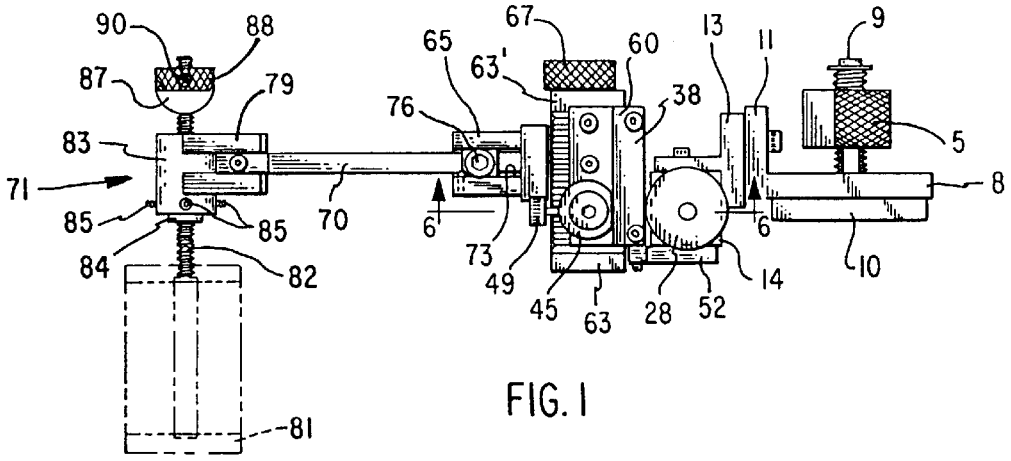
FIG. 1 is a top plan view of a bow sight holder embodying the improved adjustment devices.
Figure 2:
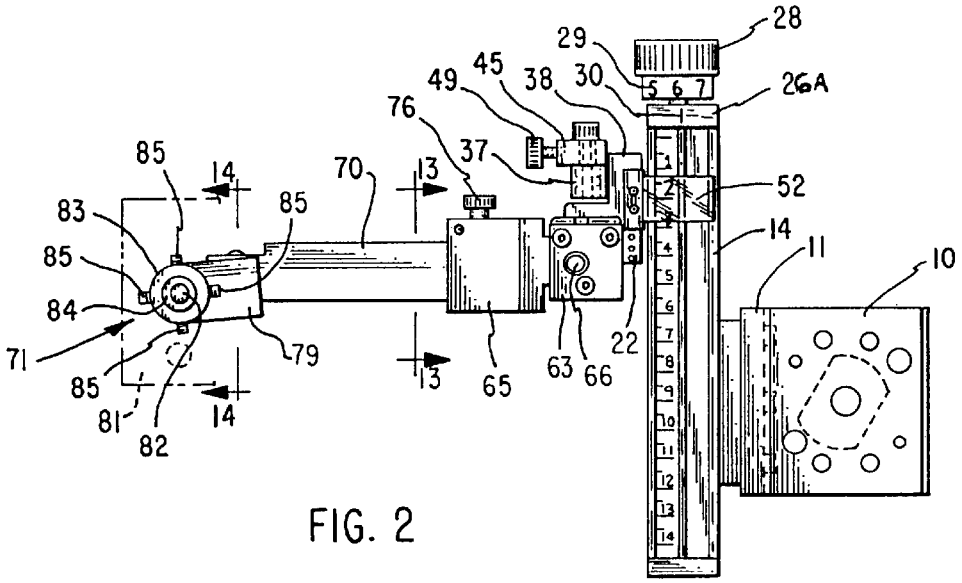
FIG. 2 is a front elevational view of the holder shown in FIG. 1.
Figure 13:
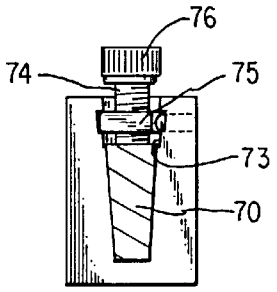
FIG. 13 is a sectional view from 13—13 of FIG. 2.
Figure 14:
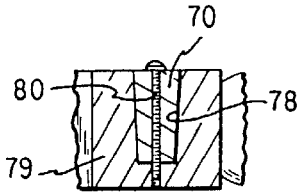
FIG. 14 is a sectional view from line 14—14 of FIG. 2.

Briefly, this invention comprises an improved carrier or mount for a bow sight useful to archers who demand accuracy and convenience in setting the bow sight to achieve their need. More specifically, this invention comprises a carrier for a sight which can be quickly and very accurately adjusted to meet the requirements of the most demanding situations.

More specifically, the usual carrier includes a section to fasten the device to the bow; a section for vertical adjustment; a part for adjustment in the horizontal direction of the arrow flight and a holder for the sight device which may be laterally displaced from the bow. This carrier includes each of those parts, several of which have been improved.

In the fastening section the present device uses a first plate 10 having a flange 11 by which the vertical adjustment section (described later herein) is held in place. A second plate 8 is adapted to fit opposite the plate 10 and is provided with a pair of aligning posts 12 and a screw threaded attachment stem 9. These aligning posts 12 fit into aligning holes 7 in the first plate 10 to hold the two plates in proper alignment. It is envisioned the holes 7 may be in alternate places (preferably at opposite corners) to provide that the plates may be turned 90° from a first position to an alternate second position.

A hole 6 of relatively enlarged size is provided in the plate 10. This hole is large enough so that the knurled nut 5 which is threaded onto the stem 9 can pass through the hole 6. The nut 5 may be formed with flat sides 5' to provide added force surfaces for tightening the nut 5.

A centering and holding device is located within a slot 4 formed in the stem 9. A pair of dogs 3 is located there to form that centering device. These dogs 3 are of identical shape but are placed in opposite directions within slot 4. In this position they each include a tapered surface 2 on a dog 3 to engage the edges of the hole 6 and an added tapered surface 1 on the other end of each dog 3 to be engaged by the nut 5 as it is screwed down tightly. A ring 73 formed of an elastic material such as rubber is engaged in hooks 64 formed in the dogs 3 serves to hold the dogs 3 radially within the slot.

In use, the plate 8 is fastened to the bow (not shown). The nut 5 is loosened, and as a result the surfaces 2 on the dogs 3 are retracted by the ring 73 enough to clear the edges of the hole 6 so that the plate 10 can be placed over the nut 5 and the dogs 3. After that the nut 5 can be run down on the stem 9 until it engages the sloped surface 1 on each dog. Because the individual surface 1 on each dog 3 is opposite the surface 2, the pressure of the nut 5 will cause the dogs 3 to spread resulting in engagement of the surfaces 2 with the edges of the hole 6, and therefore the holding of the plate 8 to the plate 10. Further tightening of the nut 5 will cause the further spreading of the surface 2 so that the hole is perfectly centered on the plate 8. Thus, there is an aligning of the plate by this means as well as substantial control from the posts 12 on the plate 8.

The vertical adjustment section is fastened to a flange 11 of the plate 10 and includes a bracket 13 to which is fastened a square, hollow post 14. It will be obvious that the post 14 can be fastened to the bracket 13 for adjustment. For example, a T-shaped slot 15 (FIG. 7) can be formed in the post 14 in which the head 16 of a screw 17 may be slidably disposed. A nut 18 can then be used to tighten this screw 17 to hold the two posts in position. For best results, applicant prefers that serrated transverses and matching ridges be formed on the matching face of the bracket 13 and post 14 to assure positive location between the two posts. Such serrations are common in the art.

Figure 6:
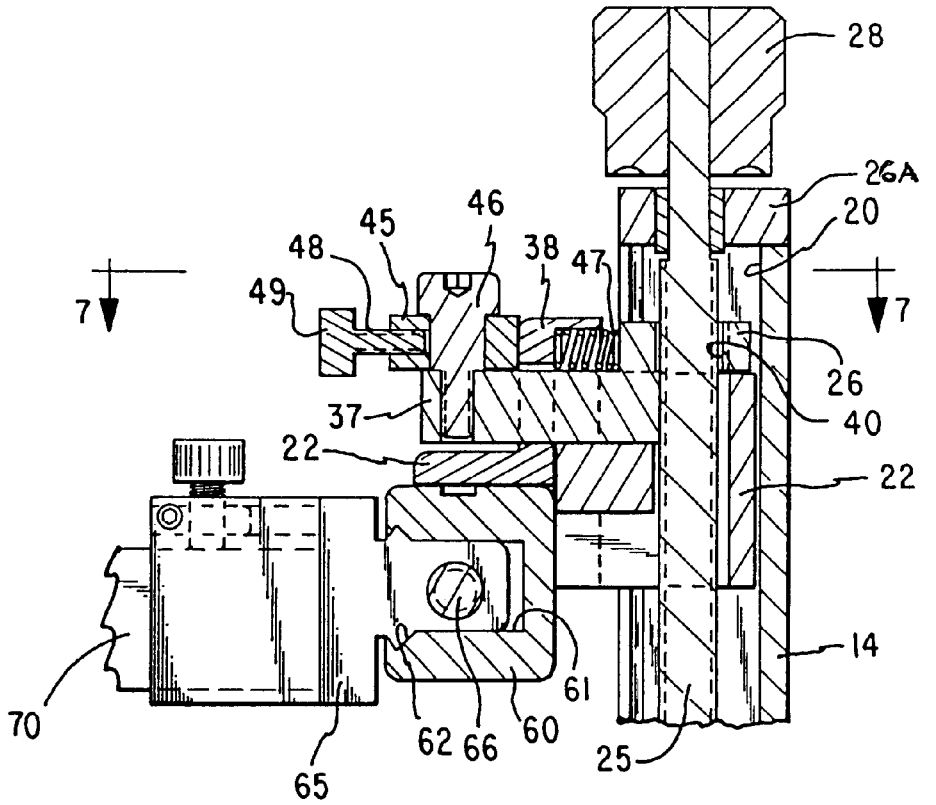
FIG. 6 is a partial sectional view of the holder shown in FIG. 1, taken from line 3—3 of FIG. 1.
Figure 8:
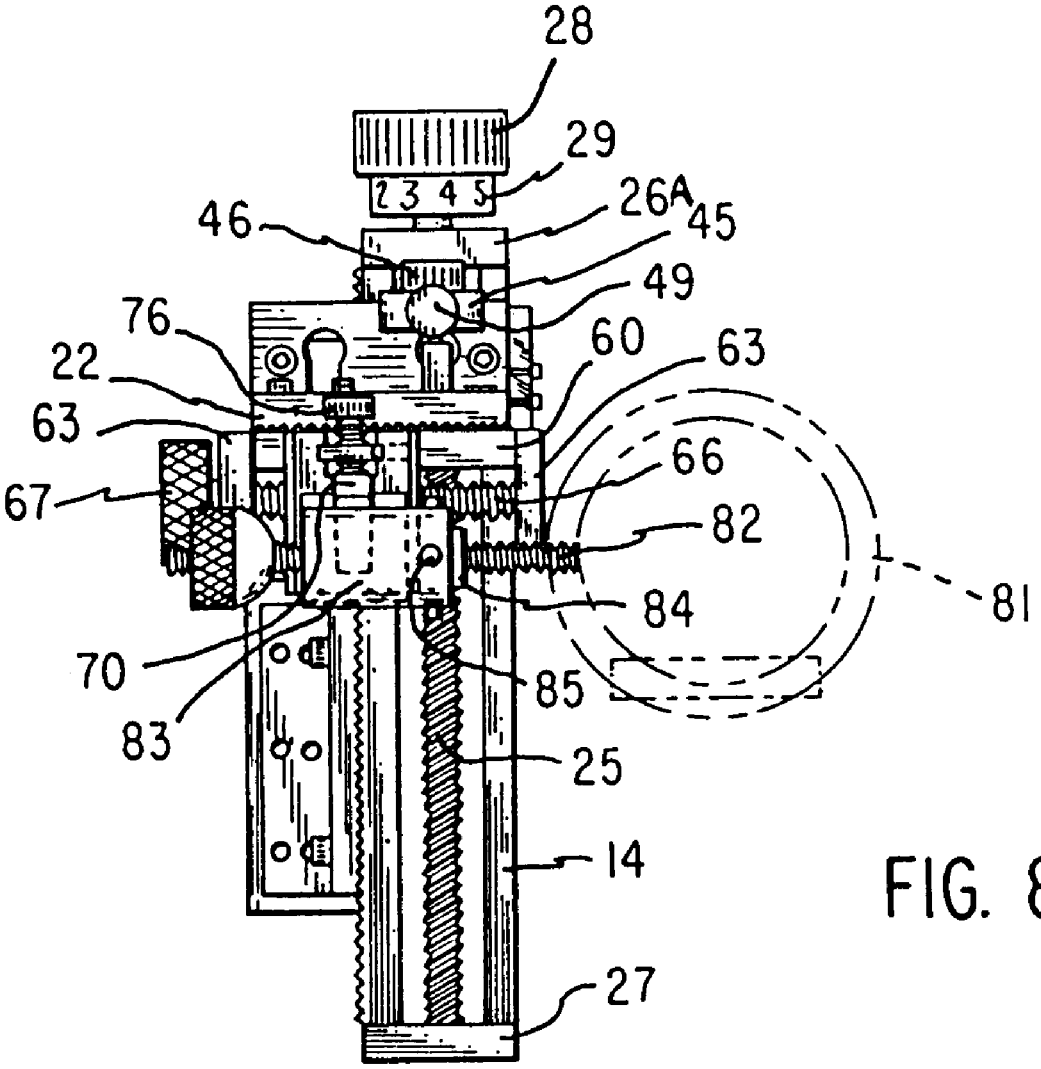
FIG. 8 is an elevational view of the holder shown in FIG. 1 taken from the left hand side of that Figure.
Figure 10:
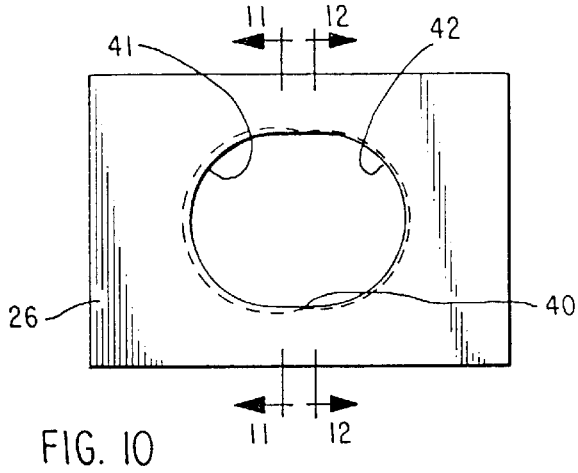
FIG. 10 is a detailed plan view of the dual nut to an enlarged scale and isolated from other parts.
Figure 11:
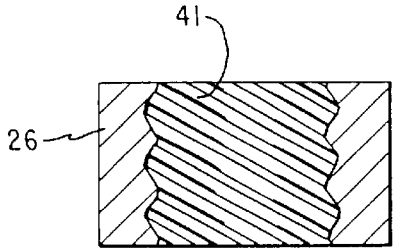
FIG. 11 is an elevational view from line 11—11 of FIG. 10.
Figure 12:
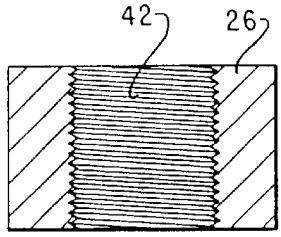
FIG. 12 is an elevational view from line 12—12 of FIG. 10.

The post 14 is formed with a longitudinal channel 20 (FIGS. 6 and 7) having an open side 21. A carrier 22 is slidably mounted in the channel 20 and is designed to be adjusted vertically with that channel. Control of the position of the carrier is accomplished by the interplay of a threaded shaft 25 and a novel arrangement of a divided nut 26. The shaft 25 is rotatably journalled in both the top cover 26A and bottom cover 27 of the post 14, and is turned by a knob 28. Because it may be desired to replicate the setting of the shaft 25, a series of members or other indicia 29 may be printed on the knob adjacent to an index line 30 on the top cover 26A. In order to maintain smooth operation and the best possible alignment, a V-groove 31 forming a sliding keyway may be used as a guide.

Figure 9:
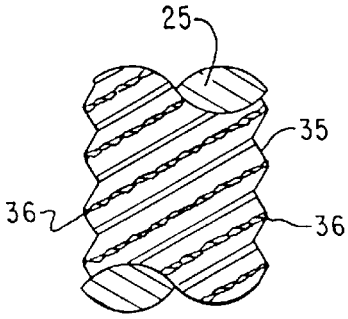
FIG. 9 is a detailed elevational view to an enlarged scale of the screw means with dual threads.

The threaded shaft 25 and its engaged nut 26 are important to the proper operation of the device because they allow, in a single device, for both a quick and coarse adjustment, and alternatively, a fine adjustment. To do this, the shaft 25 is formed with a relatively coarse-pitched thread 35 (FIG. 9). The pitch of this thread may be of the order of 0.30 inches so that if there are 10 indicia on the circumference of the knob 28, the carrier 22 would be moved about 0.03 inches with each interval between indicia. This spacing is, however, much too great for proper adjustment of the sights. Therefore, in order to provide proper adjustment, a second thread is also formed on the shaft 25.

To provide the second thread, the first thread 35 is formed with a smooth cylindrical exterior instead of a sharp edge. A very fine thread 36 is cut into that cylindrical exterior. Thus, there is a coarse thread 35 having a relatively coarse pitch and a thread 36 having very fine pitch superimposed onto the coarse pitch and all on the same shaft.

In order to take advantage of the combination of a coarse, quick adjustment and the fine, accurate adjustment thus available on the same shaft, applicant provides a divided nut 26. This nut is slidably located on a slide member 37 above the carrier 22 and beneath a yoke 38 attached to the carrier 22. Thus, the nut member 26 can be slid axially of the shaft 25 for a slight distance.

Figure 7:
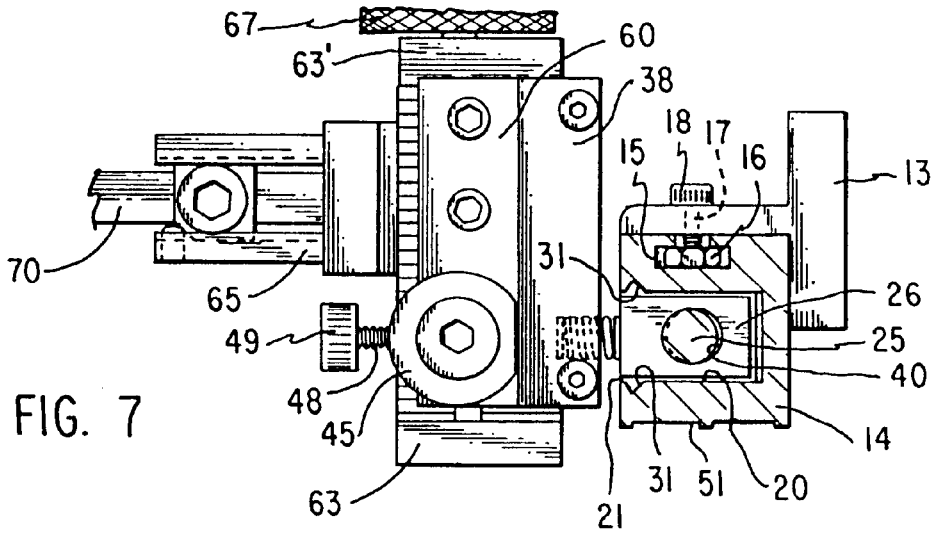
FIG. 7 is a sectional view from line 7—7 of FIG. 6.

The nut 26 itself is formed with an elongated opening 40 adapted to embrace the shaft 25 as is shown in FIG. 7. One side of the opening 40 has coarse grooves 41 formed in it to engage the coarse threads 35. The opposite side of the opening has fine grooves 42 which are engageable with the fine threads 36 on the shaft. Thus, the nut can be slid from engagement with one set of threads into engagement with the other.

The sliding necessary to change the threadable engagement is accomplished by an eccentric or flattened disc 45. This disc is journalled on a pin 46. The disc 45 is pressed into engagement with the yoke 38 by a compression spring 47 engaged between the yoke 38 and the nut 26, thus biasing the nut in the direction toward the column on post 14. Preferably, this bias will move the fine threads 36 and grooves 42 into engagement with each other although it will be obvious that a reversal of engagement might also be used.

Figure 3:
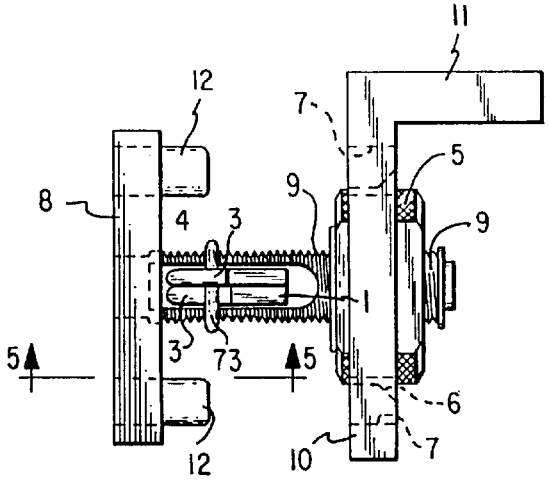
FIG. 3 is a detailed side elevational view of the novel collet for fastening the holder to a bow, apart from the holder.
Figure 4:
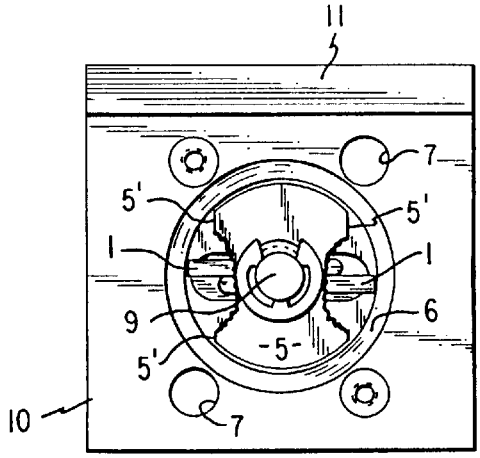
FIG. 4 is an end elevational view of the collet shown in FIG. 3.
Figure 5:
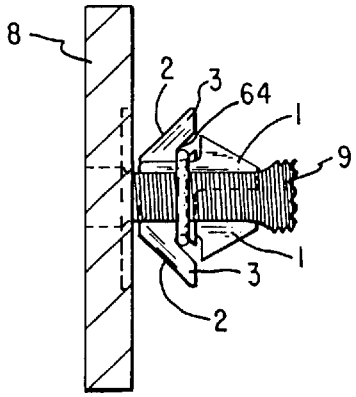
FIG. 5 is a detailed view from line 5—5 of FIG. 3.

The pin 46 is shown as threaded into an opening in the slide member 37. It will be obvious that the threaded engagement may not be necessary, so long as the pin is fixed onto that slide. By this arrangement, a turning of the disc 45 away from the position with its flat side engaging the yoke 38 will cause the slide member 37 to be pulled (to the left in FIGS. 3 and 4) so as to slide the nut member 26 in that same direction and thus to change the threaded engagement from the coarse to the fine threads or the reverse. The device illustrated to allow such turning is a threaded peg 48 having a knurled head 49 although many other convenient devices may be conceived of for such a purpose.

Because replication of the vertical setting of the sight may often be desirable, a numbered scale 50 may be removably placed in a groove 51 formed in the post 14. A magnifying device 52 may be carried by the carrier 22 over the scale for ease in reading that scale.

Lateral adjustment of the sight is accomplished by a device which may be similar to the vertical adjustment mechanism. A lateral channel member 60 which may be similar in cross section to the post 14 is carried by the carrier unit. Thus, the slotted opening 61 also includes the V-shaped keyway 62. The opening 61 is capped at each end by caps 63 and 63'. An arm holder 65 is slidably journalled in the opening 61 and is moved within that spacing by reason of a threadable engagement with a screw 66 journalled at both ends in the caps 63 and 63'. A knob 67 may be used to control the screw 66 and therefore to control the position of the arm holder 65 within the opening 61 in the channel member 60.

The arm holder 65 is designed to hold an arm 70 which in turn carries a mounting 71 for the actual sight. This arm 70 must be firmly set so that there is no play or movement relative to the assembly. To accomplish that goal, the device embodying the present invention includes the particular arm 70 which has a lateral cross section in the shape of a trapezoid having tapered sides fitting the taper of a socket 73 in the holder 65. A screw device 74 threaded into the top 75 of the socket 73 may be used to press the arm 70 into the socket so as to provide a tight fit with no space for any movement. Any type of device such as a knob 76 or a wing nut arrangement may be used to give the user of the sight an easy way of tightening the screw device 74.

At the end of the arm 70 remote from the adjustment mechanism thus far described, an adjustable mounting 71 for the actual sight is carried. In the figures this mounting 71 is affixed to the arm 70 by a slightly different means. The arm 70 with its tapered cross section is still fitted into a tapered slot 78 in the mounting bracket 79 of the mounting 71. A simple screw 80 extending through the arm 70 and threaded into the bracket 79 is then used to pull the arm 70 into tight fit with the bracket.

The sight 81 itself is carried on a threaded member 82 extending through an opening in a cylindrical part 83. A bushing 84 formed of nylon or similar plastic material which may be slightly flexible is fitted into one end of the opening in the post 83. The threaded member 82 extends through the bushing 84 in a snug but not a tight fit. Four substantially equally spaced set screws 85 are threaded into the part 83 in position to press readily onto the bushing 84. By alternately tightening or loosening diametrically opposite screws 85 some slight adjustment of the threaded member 82 relative to the part 83 is possible. This adjustment may be only of the order of thousandths of an inch, but that may still be significant in the position of the sight 81.

At the end of the cylindrical part 83 opposite the sight, a cup shaped socket (not shown) is formed. A hemispherical shape 87 on a threaded nut 88 fits into the socket so that the threaded member 82 can be tilted slightly by use of the set screws 85. In use, the threaded member 82 is moved to approximately the position needed for the sight 81. This is possible either by threading the member 82 through the bushing 84 or pushing it through that bushing. Because the bushing 84 is relatively soft and is not formed with threads, either method is possible. When that position is reached, the nut 88 is threaded onto the member 82 until it fits into the socket in the cylindrical post 83. The screws 85 can then be used to tighten and adjust the member 82 into the bushing 84. Further and firmer lateral adjustment of the sight is accomplished by use of the adjustment screw 66 so that accurate adjustment is not completely dependent on the position of the nut 88. However, in order to maintain the position of that nut, a set screw 90 is provided to hold the nut 88 in a set position on the member 82.

Applicant has by his invention provided a bow sight mounting device which allows for full adjustment by both quick and easily used adjustment devices, but also by a unique double threaded screw makes possible both quick adjustment and finely accurate adjustment in the same mechanism. From the previous description the operation of the device should be apparent to anyone reasonably skilled in the art.

What is claimed is:

1. A holder for mounting a bow sight onto an archery bow comprising pad means for fixing said holder to said bow, vertical adjustment means on said pad means including unitary structure allowing at least two speeds of adjustment in said structure, lateral adjustment means engaging said vertical adjustment means for laterally moving said sight, a detachable arm engaged between said lateral adjustment means and said sight for extending the position of said sight, and mounting means on said arm for holding said sight releasably to said arm, in which said vertical adjustment means includes a threaded shaft having dual threads on said single shaft and nut means for alternate engagement with said dual threads.

2. The holder of claim 1 in which said pad means includes a first plate for attachment to the bow, a second plate attached to said vertical adjustment means and a quick fastening means between said first plate and said second plate for rapid, easy correction of said second plate to said first plate.

3. The holder of claim 2 in which said quick fastening means includes a threaded stem on said first plate having a nut threaded stem on said first plate having a nut threaded thereon, said second plate including a hole through which said stem and must extends, said stem be formed with a slot, dog means movably placed within said slot extendible from a retracted position in which said dogs can be inserted through said hole to an extended position where a surface of each dog can be inserted through said hole to an extended position where a surface of each dog engages an edge of said hole to prevent extraction, said nut being engageable with said dogs to cause motion from said retracted position to said extended position.

4. The holder of claim 3 in which an elastic ring surrounds said stem and engages said dogs to hold said dogs within said slot.

5. The holder of claim 1 in which said dual threads include a first thread having a coarse pitch and a second thread having a fine pitch, said nut means including two separate parts, a first part being engageable with said first thread and a second part engageable with said second thread.

6. The holder of claim 5 in which said vertical adjustment means comprises a hollow post attached to said pad, said post having a central hollow longitudinally of said post, caps at each end of said post to enclose said hollow, said hollow having a slotted opening to the outside, said lateral adjustment means being slidably disposed in said slotted opening, said thread shaft being journalled at its ends in said caps and including a means for turning said threaded shaft at a first end whereby said threads can be turned within said post.

7. The holder of claim 6 in which said lateral adjustment means includes a carrier unit carried by said vertical adjustment means, a threaded shaft journalled in said carrier unit and nut means engaged with threaded shaft for carrying said detachable arm in a lateral direction relative to said sight.

8. The holder of claim 6 in which said slotted opening includes a guide slot, said lateral adjustment means having a key slidably engaged in said guide slot to provide guided sliding engagement between said post and said lateral adjustment means.

9. The holder of claim 6 in which indicia are marked on at least one side of said post, means on said lateral adjustment means extending across said indicia and cooperating with said indicia for indicating vertical position of said lateral adjustment means relative to said post.

10. The holder of claim 1 in which said lateral adjustment means includes screw-threaded means for moving said sight laterally of said holder.

11. The holder of claim 10 in which said screw-threaded means includes a carrier unit carried by said vertical adjustment means, a threaded shaft journalled in said carrier unit, and nut means engaging said threaded shaft for carrying said detachable arm in a lateral direction relative to said sight.

12. The holder of claim 1 in which said lateral adjustment means includes an arm holder, said arm holder being formed with a socket having walls defining a trapezoidal cross section, said detachable arm having a matching cross section to said socket and means on said arm holder to press said arm into said socket.

13. An adjustment device for a bow sight including a hollow member carriage means slidably disposed in said hollow member, a threaded shaft rotatably journalled in said hollow member having dual threads, a movable nut device slidably mounted on said carriage means, said nut device being slidable between two positions, a first position in which said nut device engages a first thread on said threaded shaft and a second position in which said nut device engages a second of said dual threads on said threaded shaft.

14. The device of claim 13 in which said first thread is a coarse thread having a cylindrical outer surface and said second thread is a fine thread formed on said outer surface.

15. The device of claim 14 in which said nut device includes a slotted opening embracing said threaded shaft, said slotted opening being elongated to provide for alternate engagement between a first side of said opening with said first thread and a second side of said opening with said second thread.

16. The device of claim 15 in which said nut device is engaged by operating means for moving said nut means between engagement between said first side and said second side with said threaded shaft.

* * * * *